United States Patent [19]

Navarro

[11] Patent Number: 4,669,678

[45] Date of Patent: Jun. 2, 1987

[54] PAPER WINDING DEVICE

[76] Inventor: Pablo Navarro, 705 Canden Rd., Altamonte Springs, Fla. 32714

[21] Appl. No.: 784,600

[22] Filed: Oct. 4, 1985

[51] Int. Cl.[4] ..... B65H 17/02

[52] U.S. Cl. ..... 242/67.3 R; 242/75.5

[58] Field of Search ..... 242/67.1 R, 67.2, 67.3 R, 242/55, 75.5, 75.51

[56] References Cited

U.S. PATENT DOCUMENTS

| | | | |
|---|---|---|---|
| 1,872,098 | 8/1932 | Thomas | 242/67.1 R |
| 3,857,527 | 12/1974 | Kranz | 242/75.5 |
| 4,065,068 | 12/1977 | Treadwell | 242/67.1 R |
| 4,135,676 | 1/1979 | Hunter | 242/67.3 R X |
| 4,346,854 | 8/1982 | Markus et al. | 242/67.1 R |

*Primary Examiner*—Stuart S. Levy
*Assistant Examiner*—David Werner
*Attorney, Agent, or Firm*—Macdonald J. Wiggins

[57] ABSTRACT

A gravity controlled automatic paper winder for continuous type paper form a printer has a spool supported by a framework. The spool is coupled by a ratchet assembly to a motor and gear reduction assembly and permits the spool to rotate only in a direction to wind paper onto the spool. The motor and gear reduction assembly is supported only by the gear reduction output shaft and is free to rotate about the ratchet assembly. A limit switch on the framework controls power to the motor. When paper is fed from a printer to the spool, the motor and gear reduction assembly rotates downward by gravity to contact the limit switch, energizing the motor. When no paper is fed from the printer, tension due to rotation of the spool causes the motor and gear reduction assembly to rotate upward, opening the limit switch and deenergizing the motor.

6 Claims, 5 Drawing Figures

PAPER WINDING DEVICE

BACKGROUND OF THE INVENTION

1. Field of the Invention

The present invention relates to devices for winding paper, and more particularly to a device for use in conjunction with a computer printer or teletypewriter machine for automatically rolling up paper as it comes from the machine.

2. Description of the Prior Art

The widespread use of teletypewriter machines, such as in Teletype® and Telex® service, and the use of computers to print out large amounts of data, have created a problem as to the storage of the printed output when the apparatus is unattended. While the prior art discloses various types of paper winders for printers, cash registers, computers and the like, none of these provide a simple low cost winder. The majority of the known devices are typified by U.S. Pat. No. 3,113,742 to Bevin et al. This patent discloses a motor driven winder which utilizes a slip clutch to stop the winding operation when all of the paper has been taken up. Bakker, in U.S. Pat. No. 4,492,345, teaches an adding machine tape rewinder in which the feeding of the paper from the roll causes the takeup reel to rotate by friction. An inertia actuated switch is shown in the Runde patent, U.S. Pat. No. 2,843,247. Here, rapid acceleration and deceleration of the paper carriage causes a weighted arm to swing and to wind the paper up through a ratchet and pawl arrangement.

Other U.S. patents to paper winders are as follows: Prout et al, U.S. Pat. No. 2,776,804; Blandino, U.S. Pat. No. 3,314,623; Majors, U.S. Pat. No. 3,447,657; and Bush, U.S. Pat. No. 4,043,440.

All of these disclosed devices are relatively complex and expensive. Therefore, there is a need for a low cost simple paper winder which will automatically wind paper from a printer as the printer operates.

SUMMARY OF THE INVENTION

My invention is a paper winding device for printers of any type. This device has a spool upon which the paper will be rolled mounted between two uprights on a base. A drive shaft coupled to the spool is attached to a ratchet mechanism which permits the spool to turn only in a direction to wind paper thereon.

The ratchet has an output shaft which may be square similar to a socket wrench ratchet handle as is well known in the art. A small gear reduction motor assembly, similar to motors used for rotating barbecue spits, is provided having an output shaft with a recess which fits the square drive of the ratchet assembly and which is attached to the output gear of the gear reduction train. The gear reduction system is driven by a small fractional horsepower motor for operation from the ac power line. The motor and gear reduction assembly is installed on the square shaft and supported entirely by the shaft. The coupling to the shaft is advantageously at one end of the gear reduction motor unit such that the gear reduction and motor unit will tend to rotate by gravity with respect to the uprights and base of the device. A limit switch, preferably of the Microswitch® variety is mounted on the base such that, when the spool is free to turn, the motor and gear reduction assembly will rotate downward by gravity to contact the switch. The switch is connected in series with the drive motor and the power line and serves to operate the motor. The motor then rotates in a direction to roll up paper onto the spool which will occur as long as paper is fed to the spool at a faster rate than the rotational rate of the spool. If the printer should stop, the paper will be placed under tension by the action of the motor in continuing to wind the paper. In this instance, the motor and gear assembly will then attempt to rotate about the shaft in an opposite direction to the rotation of the spool. This lifts the assembly clear of the Microswitch® which opens the electrical circuit to the drive motor, stopping the motor.

When feeding of paper from the printer resumes, slack is created permitting the motor and gear reduction assembly to drop by gravity to thereby close the Microswitch®. This reenergizes the motor and the cycle is repeated. As will now be recognized, the device utilizes gravity to energize and deenergize the motor as paper emanates from a printer. Thus, an extremely simple and trouble free device is provided which requires no slip clutches or other complex devices.

It is therefore a principal object of my invention to provide a paper winder for use with printers of all types which is simple, economical and completely automatic.

It is another object of my invention to provide a paper winder in which the operation thereof is controlled by a gravity switch.

It is still another object of my invention to provide a paper winder in which the weight of the drive motor and gear reduction system is utilized to start and stop the winding of paper.

These and other objects and advantages of my invention will become apparent from the following detailed description when read in conjunction with the drawings.

DETAILED DESCRIPTION OF THE PREFERRED EMBODIMENT

Figure 1:
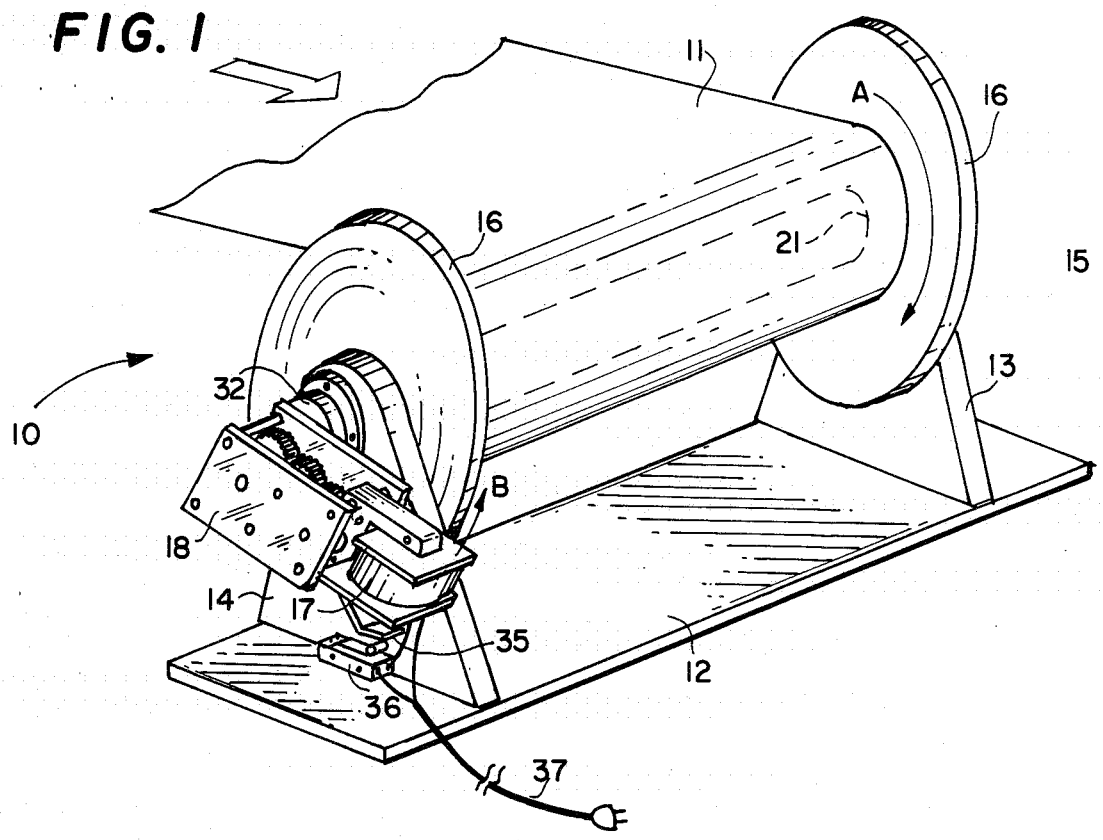
FIG. 1 is a perspective view of the preferred embodiment of my invention illustrating the main elements thereof.

Referring to FIG. 1, a perspective view of a preferred embodiment of my invention is shown. A base 12 is provided having a pair of standards 13, 14 for supporting a spool 15 having a core 21 shown in phantom view and spool ends 16. Case 21 includes any suitable means for anchoring the end of continuous type paper to be wound. If desired, spool 15 may be made removable by a hinge on standard 13 or any other arrangement which may be obvious to those of skill in the art.

Spool core 21 is coupled to a ratchet assembly 32 to be described more fully hereinafter which permits spool 15 to rotate in the direction indicated by arrow A only. Coupled to the output shaft of the ratchet assembly 32 is gear reduction assembly 18 driven by motor 17. Motor 17 and gear reduction assembly 18 are preferably of the type utilized in home barbecue grills for rotating a spit and will have an output rotational speed of about 2-3 rpm. As will be understood, the output rotation direction of gear reduction assembly 18 is indicated by arrow A. A limit switch 36, which may be a Microswitch ® having a roller operating lever, is attached to base 12 and is connected in series with motor 17 and connected to the ac power line by line cord 37. An actuator arm 35 is attached to gear reduction assembly 18 for contacting the operating lever of limit switch 36. Although not shown, a line switch is also included to turn off the power when the winder is not is use.

As will be recognized, gear reduction assembly 18 and motor 17 are attached to ratchet assembly 32 and are supported entirely therefrom. Therefore, gear reduction assembly 18 and motor 15 are free to rotate about that shaft. When motor 17 is operating, spool 15 will be rotating in the direction shown by arrow A and paper 11 will be rolled onto core 21 and will move in the direction shown by the solid arrow. This operation will continue as long as there is paper free to be spooled. However, when paper 11 ceases to emanate from the printer, spool 15 will be placed under tension from the paper. In this instance, the motor will continue to run and gear reduction assembly 18 will therefore cause the assembly and motor 17 to move in the direction shown by arrow B. This lifts operating arm 35 from limit switch 36 causing motor 17 to stop.

Figure 2:
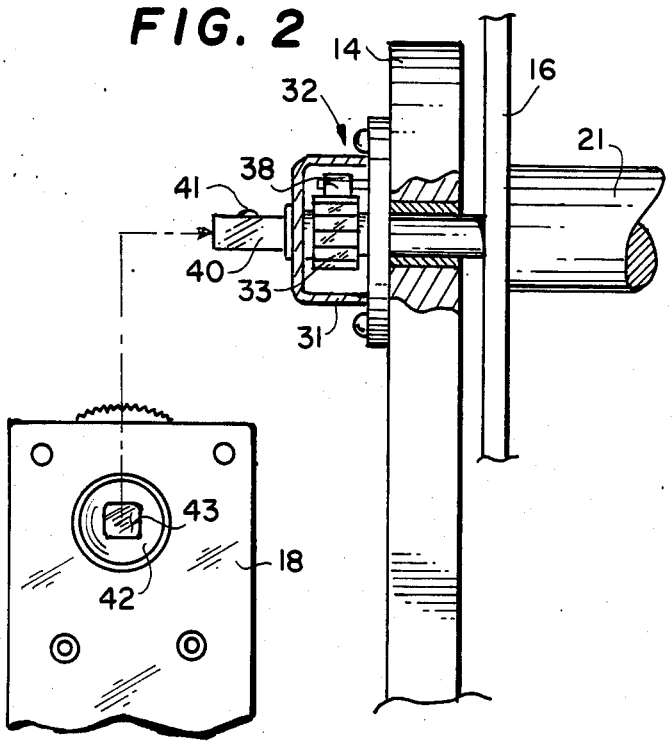
FIG. 2 is a cross-sectional view of the clutch assembly of the device of FIG. 1 and a partial view of the motor and gear reduction assembly.

Turning now to FIG. 2, details of the ratchet assembly and the method of attaching gear reduction assembly 18 is illustrated. Ratchet assembly 32 may be of the type used with a ratchet handle for socket wrenches or the like. In the housing 31, shown cut away, is seen a ratchet wheel 33 and spring loaded pawl 38. The input to ratchet assembly 32 is a square shaft 40. Gear reduction assembly 18 is shown in partial view indicating an output shaft 42 having a square recess 43 complementary to square shaft 40. As indicated by the dashed line, the recess 43 is coupled to square shaft 40 and held in place by friction ball 41 with shaft 40 thus representing the sole support for the assembly 18 and motor 17.

Figure 3A:
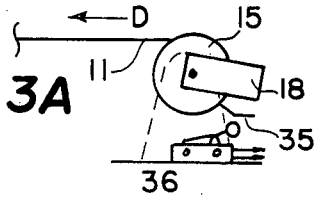
FIGS. 3A, 3B, and 3C are schematic representations of the automatic operation of my invention.
Figure 3B:
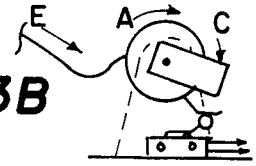
Figure 3C:
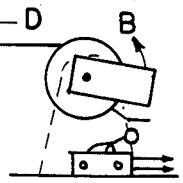

The operation of my invention may be best understood with reference to FIGS. 3A–3C. Here, a schematic representation is shown of spool 15 winding paper 11 thereon. In FIG. 3A, the printer is assumed to be stopped and tension, as indicated by arrow D, is placed on paper 11. In this situation, gear assembly 18 has moved upward such that actuating arm 35 does not contact limit switch 36 and motor 17 is off. In FIG. 3B, paper has been fed from a printer as indicated by arrow E placing slack in paper 11. This permits the weight of assembly 18 and motor 17 to rotate downward as shown by arrow C closing Microswitch ® 36. This energizes motor 17 causing spool 15 to rotate as indicated by arrow A . As paper 11 is wound onto spool 15, this process will continue as long as paper is fed as indicated by arrow E. When the printer again stops, motor 17 will continue to run for a short time causing the assembly 18 and motor 17 to rotate upward as indicated by arrow B permitting Microswitch ® 36 to open shutting off motor 17 ready for the next cycle.

As will now be apparent, I have disclosed a simple low cost paper winder for printers of all types and which will operate automatically when a requirement for rewinding paper onto an outlet spool is present. By using the weight of the motor and gear drive assembly in a novel manner to control the operation of the motor, I have eliminated expensive mechanisms which would otherwise be required. Although I have shown a preferred embodiment as an example of an implementation of my invention, I am not to be limited to this specific design shown since it would be obvious that many changes in the example can be made without departing from the spirit and scope of my invention.

I claim:

1. An automatic paper winder for printers and the like comprising:

a paper spool for winding continuous paper thereon, said spool having a driving shaft;

a base and stand for supporting said spool;

a gear reduction electric motor connected to said spool for rotating said spool, said motor having an output shaft connected to said driving shaft and supported entirely thereby such that the weight of said motor maintains tension on said continuous paper when not being would on said spool; and control switch means attached to said base and electrically connected to said motor for control thereof, wherein said motor moves by gravity to close said switch means to energize said motor when tension on said continuous paper is released.

2. The winder as defined in claim 1 which further comprises ratchet means attached to said paper spool for permitting said paper spool to be rotated in a direction to wind said paper onto said paper spool.

3. The winder as defined in claim 2 in which:

said paper spool includes a core portion for attachment of said paper thereto;

said ratchet means inclues a ratchet wheel having an input shaft and an output shaft, said output shaft connected to said driving shaft of said spool; and a pawl engaged with said ratchet wheel for permitting said ratchet wheel to rotate in one direction only.

4. The winder as defined in claim 1 in which said control switch means includes a limit switch attached to said base such that when said gear reduction electric motor moves by gravity, said limit switch will be contacted and closed thereby energizing said motor, and in which said limit switch will be open when said gear reduction electric motor moves upward in response to tension on said spool from said paper thereby turning said motor off.

5. A gravity controlled automatic paper winder for printers and the like comprising:

a spool for winding paper thereon;

a framework for holding said spool;

a ratchet assembly having an input shaft and an output shaft, said output shaft connected to said spool for rotating said spool only in a direction to wind paper thereon;

a gear reduction electric motor assembly having an output shaft, said shaft connected to said input shaft of said ratchet assembly, said motor assembly supported only by said ratchet assembly;

a normally open-circuit limit switch disposed on said framework and connected to a power source and to said motor assembly for energizing said motor assembly when said switch is closed; and an actuator arm attached to said motor assembly, said motor assembly being free to rotate by gravity about said input shaft when no tension is present on said spool from said paper to thereby cause said actuator arm to contact and close said limit switch thereby energizing said motor for winding said paper onto said spool, and said energized motor assembly causing said motor assembly to rotate against gravity when tension is present on said spool from said paper thereby causing said actuator arm to cause said limit switch to open thereby deenergizing said motor assembly.

6. The winder as defined in claim 5 in which said gear reduction electric motor assembly includes:

an electric motor; and a gear reduction assembly driven by said electric motor and having an output shaft connected to said input shaft of said ratchet assembly.

* * * * *